United States Patent [19]

Gesensway

[11] Patent Number: 4,903,507

[45] Date of Patent: Feb. 27, 1990

[54] ATTACHMENT FOR A FINGER RING

[76] Inventor: Sheldon Gesensway, 555 NE. 15th St., Gallery 10, Miami, Fla. 33132

[21] Appl. No.: 355,276

[22] Filed: May 22, 1989

[51] Int. Cl.[4] ..... A44C 9/02

[52] U.S. Cl. ..... 63/15.6; 63/15.45

[58] Field of Search ..... 63/3, 5.1, 11, 15, 15.5, 63/15.6, 15.65, 15.45

[56] References Cited

U.S. PATENT DOCUMENTS

| | | | |
|---|---|---|---|
| 1,754,392 | 4/1930 | Levin | 63/15.6 |
| 3,238,741 | 3/1966 | Johnson | 63/15.6 |
| 3,261,181 | 7/1966 | Scott . | |
| 3,360,959 | 1/1968 | Schechter et al. . | |
| 3,385,079 | 5/1968 | Von Hollen . | |
| 3,483,718 | 12/1969 | Lodrini . | |
| 4,043,145 | 8/1977 | Chervin . | |
| 4,362,031 | 12/1982 | Obermüller | 63/15 |

FOREIGN PATENT DOCUMENTS

| | | | |
|---|---|---|---|
| 22616 | 7/1905 | Austria | 63/15.6 |
| 1140768 | 12/1962 | Fed. Rep. of Germany | 63/15.6 |

*Primary Examiner*—James R. Brittain

*Attorney, Agent, or Firm*—Norman B. Rainer

[57] ABSTRACT

An attachment device for a finger ring prevents the ring from turning upon the finger, and enables the ring to fit upon fingers of different circumferential size. The device is made of a malleable metal component and a resilient band. The metal component is capable of being bent so as to grip the ring and also form two loops which retain the resilient band within the perimeter of the ring and in a plane perpendicular to the axis of the ring.

5 Claims, 1 Drawing Sheet

ATTACHMENT FOR A FINGER RING

BACKGROUND OF THE INVENTION

This invention relates to finger rings of the type worn as items of ornamental jewelry, and more particularly concerns an improvement in the manner in which such rings fit upon the wearer's finger.

The aspect of the anatomy of a finger which is involved in the wearing of finger rings comprises the first and second phalanx bones, ligaments, tendons, flesh and the articular surfaces of these bones. Rings are normally worn encircling the shaft of the first phalanx. The proximal end of the second phalanx and the distal end of the first phalanx comprise the bone structure of the knuckle. The ends of the phalanges are enlarged to form the articular surfaces and constitute the prominence of the knuckle. The dorsal side of the first phalanx is convex and is tightly covered by skin with little compressive yield. The palmar side of the first phalanx has a yielding fleshy pad and flexion tendons more loosely covered by the skin. Thus, the portion of the finger where a ring is usually worn is an unyielding convex surface on the dorsal side and a fleshy pad on the planar side. The greatest transverse dimension of the finger is the unyielding lateral or width dimension of the knuckle of the first and second phalanges. This dimension is greater than the dimensions of the shaft of the first phalanx and the flesh encircled by a ring.

Nearly all finger rings employ a circular or substantially circular finger aperture having an interior diameter dictated by the size of the wearer's finger first joint knuckle. The ring must be large enough in diameter to slip past the knuckle. Since this interior diameter is larger than the width or depth of the shaft of the first row phalanx bones and flesh of the finger where rings are normally worn, the ring fits the finger loosely, thereby allowing the ring to turn easily.

Turning of rings about the finger is annoying since the gem or artwork carried by the finger fails to remain centered on the dorsal surface of the finger as is normally desired. The gem or artwork may rub against or injure adjacent fingers and may turn to appear on the palmar side of the hand where it may interfere with the wearer's grip, be damaged or cause damage to other objects.

The inherent looseness of circular finger rings may result in accidental loss by slipping over the wearer's knuckle during rapid hand movement or when the skin of the wearer's hand is cold, wet or lubricated with materials such as oil or soap. Valuable rings have been stolen from the hand of the wearer.

Among the various expedients earlier proposed for preventing the turning of a ring upon the finger, there has been disclosed non-circular ring shapes, rings comprised of interactive moving parts and attachment devices. Non-circular ring shapes are expensive to fabricate, and present certain inventory problems for the jeweler who must stock many different styles and sizes of rings. The presence of moving parts on the ring or on an attachment therefor presents the opportunity for eventual malfunction.

Attachment devices are often difficult to install onto a ring and generally require customized fitting by the jeweler. When so fitted, the wearer can wear the ring on just one finger. Certain attachment devices, although effective in preventing turning of the ring, cause certain discomforts to the wearer. In most instances where an attachment device is employed to prevent turning of the ring on the finger, the ring size must be made larger in order to accommodate the device which is usually disposed upon the interior of the ring. It is also well known that a person's finger diameter changes periodically in view of minor fluctuations in skin moisture and temperature. Therefore, a ring which fits perfectly on one day may not fit properly on another day.

It is accordingly an object of the present invention to provide an attachment device for a substantially circular finger ring which will prevent turning of the ring upon the wearer's finger.

It is another object of this invention to provide an attachment device as in the foregoing object which does not require customized fitting to the wearer's finger.

It is a further object of the present invention to provide an attachment device of the aforesaid nature which enables the wearer to wear the ring on any finger without turning.

It is still further object of the invention to provide an attachment device of the aforesaid nature which is self adjusting, thereby accommodating periodic changes in finger diameter.

It is yet another object of this invention to provide an attachment device of the aforesaid nature which can be easily installed upon a ring and which is amenable to low cost manufacture.

These objects and other objects and advantages of the invention will be apparent from the following description.

SUMMARY OF THE INVENTION

The above and other beneficial objects and advantages are accomplished in accordance with the present invention by an attachment device for a ring of substantially circular contour having interior and exterior surfaces, said device comprising:

(a) a clamp of monolithic construction fabricated from a piece of thin sheet stock of a malleable metal and having a base portion elongated between two extremities and adapted to be bent so as to lie against said interior surface in close conformity therewith, at least two gripping portions extending perpendicularly from said base portion adjacent the extremities thereof and adapted to be bent in the same directions so as to embrace the exterior surface of the ring, and a pair of loop-forming portions extending perpendicularly from said base portion adjacent the extremities thereof and in a direction opposite to the direction of the corresponding gripping portions, said loop-forming portions being bendable to form retaining loops positioned on the same side of the ring and adjacent the interior surface thereof, and (b) a circular rubber band having an unflexed diameter slightly smaller than the diameter of said ring, said band being held by said retaining loops and being disposed in substantially coaxial relationship with said ring.

In a preferred embodiment, a third gripping portion extends perpendicularly from said base portion adjacent the midpoint thereof and is adapted to bend around the ring in a direction opposite to the directions of bending of the gripping portions disposed at the extremities of the base portion.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
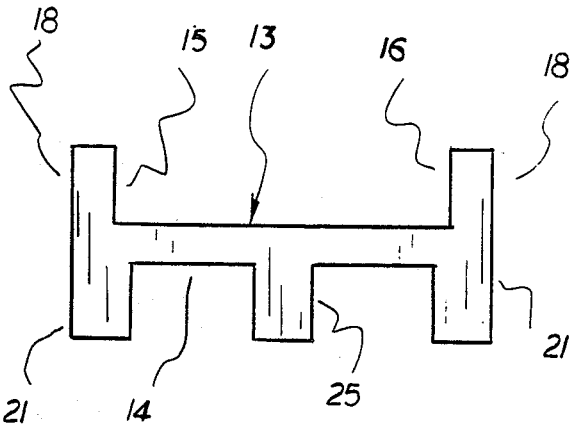
FIG. 1 is a plan view of a piece of sheet metal which serves as a precursor to the clamp component of the device of the present invention.
Figure 2:
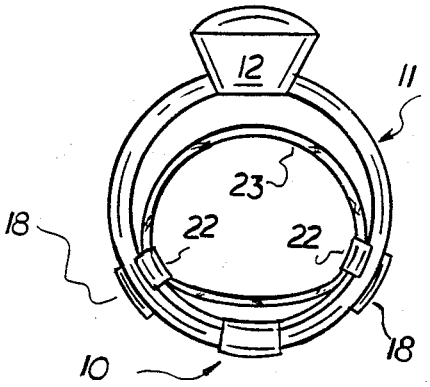
FIG. 2 is a front view of an embodiment of the device of the present invention as derived from the precursor of FIG. 1 and shown in functional association with a jewelry ring.
Figure 3:
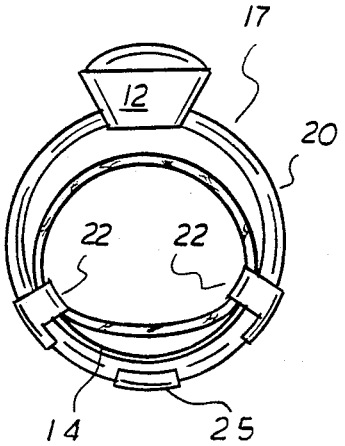
FIG. 3 is a rear view of the embodiment of FIG. 2.
Figure 4:
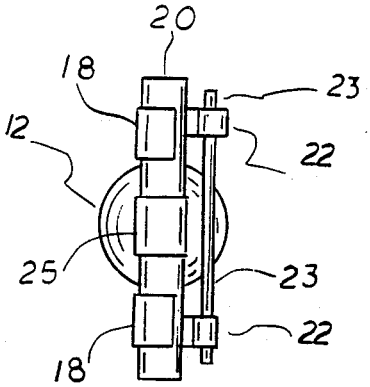
FIG. 4 is a bottom view of the device of FIG. 2.

Referring to FIGS. 1–4, an embodiment of the device 10 of this invention is mounted upon a jewelry ring 11 having a gem stone 12.

The device is comprised of a clamp 13 of monolithic construction, having been fabricated from a piece of thin sheet stock of a malleable, corrosion-resistant metal such as a silver alloy, aluminum, bronze, or the like. The clamp is fabricated from the sheet stock by cutting and bending operations. The clamp is comprised of a base portion 14 elongated between two extremities 15 and 16, and bent so as to lie against the interior surface 17 of the ring. Two terminal gripping portions 18, which initially extend perpendicularly from the base portion adjacent extremities 15 and 16, are adapted to be bent in the same directions so as to embrace the exterior surface 20 of the ring. A middle gripping portion 25 extend perpendicularly from the base portion on the opposite side from terminal gripping portions 18. In some embodiments, gripping portions 18 may be of sufficient length so as to completely traverse exterior surface 20 and bend again onto interior surface 17.

Loop-forming portions 21 extend perpendicularly from the base portion at sites opposite to the corresponding gripping portions 18. The loop-forming portions are bendable to form retaining loops 22 positioned on the same side of the ring and adjacent interior surface 17. The clamp can be fitted onto the ring using needle-nose pliers to facilitate bending and formation of loops 22, and seating of the gripping portions. A key having an elongated slot may also be used to form loops 22.

A continuous loop rubber band 23, having an unflexed circuitous diameter slightly smaller than the diameter of the ring, is held by loops 22 and is disposed in substantially coaxial relationship with ring when the ring is worn upon a finger.

In use, the wearer inserts his finger through both the rubber band and the ring. Although the ring may be loose-fitting, the rubber band prevents the ring from turning or slipping past the knuckle. Instead of a rubber band, a resilient or elastic cord in a continuous loop configuration may be used, and may have a color to match the color of the ring. The device of this invention can be utilized on inexpensive costume jewelry rings where the use of heat, as employed in securing conventional devices intended to prevent turning, would destroy the plated finish of the ring.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An attachment device for a finger ring of substantially circular contour having interior and exterior surfaces, said device comprising:

(a) a clamp of monolithic construction fabricated from a piece of thin sheet stock off a malleable metal and having a base portion elongated between two extremities and adapted to bent so as to lie against said interior surface in close conformity therewith, two gripping portions extending perpendicularly from said base portion adjacent the extremities thereof and adapted to be bent in the same directions so as to embrace the exterior surface of the ring, and a pair of loop-forming portions extending perpendicularly from said base portion adjacent the extremities thereof and in a direction opposite to the direction of the corresponding gripping portions, said loop-forming portions being bendable to form retaining loops positioned on the same side of the ring and adjacent the interior surface thereof, and (b) a resilient band defining a continuous loop having an unflexed diameter slightly smaller than the diameter of said ring, said band being held by said retaining loops and being disposed in substantially coaxial relationship with said ring when said ring is worn upon a finger.

2. The device of claim 1 having a third gripping portion extending perpendicularly from said base portion at a site substantially midway between said extremities, and adapted to bend around the ring in a direction opposite to the direction of bending of the gripping portions disposed at the extremities of the base portion.

3. The device of claim 1 wherein said piece of sheet stock is capable of being bent to a stable desired configuration without the use of heat.

4. The device of claim 1 wherein said gripping portions are of sufficient length so as to completely traverse the exterior surface of the ring and bend again onto the interior surface of the ring.

5. The device of claim 1 wherein said resilient band is a rubber band.

* * * * *